United States Patent [19]

Gerber et al.

[11] 4,102,759

[45] Jul. 25, 1978

[54] METHOD OF ELECTROLYTICALLY FORMING SILVER HALIDE GRAINS UTILIZING A NOVEL ANODE

[75] Inventors: Arthur M. Gerber, Boston; Vivian K. Walworth, Concord, both of Mass.

[73] Assignee: Polaroid Corporation, Cambridge, Mass.

[21] Appl. No.: 775,045

[22] Filed: Mar. 7, 1977

[51] Int. Cl.[2] ..... C25B 1/24; C25B 11/04; C25B 11/08

[52] U.S. Cl. ..... 204/94; 96/94 R; 204/290 R; 204/292

[58] Field of Search ..... 204/94, 290 R, 291, 204/292, 294; 96/94 R, 94, 94 BF

[56] References Cited

U.S. PATENT DOCUMENTS

| | | | |
|---|---|---|---|
| 466,720 | 1/1892 | Currie | 204/94 R |
| 1,602,595 | 10/1926 | Sheppard et al. | 204/94 R |
| 1,801,784 | 4/1931 | Schwarz | 204/180 P |
| 3,135,674 | 6/1964 | Ruetschi | 204/291 |
| 3,458,421 | 7/1969 | Dahms | 204/195 F |

FOREIGN PATENT DOCUMENTS

| | | | |
|---|---|---|---|
| 1,079,452 | 4/1960 | Fed. Rep. of Germany | 204/94 R |
| 643,223 | 9/1950 | United Kingdom | 204/94 R |

*Primary Examiner*—T. M. Tufariello
*Attorney, Agent, or Firm*—Philip G. Kiely

[57] ABSTRACT

An electrolytic cell for generating silver ions and halide ions for the formation of photosensitive silver halide grains wherein the anode comprises particulate silver.

9 Claims, No Drawings

METHOD OF ELECTROLYTICALLY FORMING SILVER HALIDE GRAINS UTILIZING A NOVEL ANODE

BACKGROUND OF THE INVENTION

Copending application Ser. No. 672,647, filed Apr. 1, 1976, now U.S. Pat. No. 4,060,491 issued Nov. 29, 1977, is directed to a method for forming photosensitive silver halide emulsions by electrolysis which comprises the steps of electrolytically generating silver ions and soluble negative ions, preferably halide, in a solution of an electrolyte, reacting the silver ions and negative ions remote from the electrode, to form grains, growing the grains to the desired size, disposing the grains in a polymeric binder such as gelatin, and coating the binder-grain composition. Conventional sensitization and addenda may be employed as desired.

The method of application Ser. No. 672,647 now U.S. Pat. No. 4,060,419, obviates the critical and tedious washing requirements of the prior art. In a preferred embodiment, the electrolytic generation of the ions is carried out in the presence of a polymeric binder material; however, the binder is not critical and the reaction can be carried out without any binder in the electrolyte solution.

Application Ser. No. 672,647 now U.S. Pat. No. 4,060,419, is incorporated herein in its entirety.

The present invention is directed to a novel electrolytic cell for use in the above-mentioned method for forming silver halide grains.

SUMMARY OF THE INVENTION

The present invention is directed to an electrolytic cell for forming silver halide grains which comprises a housing, a silver anode, a halide generating cathode and a solution of an electrolyte wherein said anode comprises particulate silver.

DETAILED DESCRIPTION OF THE INVENTION

Copending application Ser. No. 672,647 discloses a cell employing a silver anode, and, more specifically, a flat, sheet silver anode. However, silver in this form is relatively expensive and limited with respect to surface area. The employment of particulate silver provides an anode having high electrical conductivity, density, surface area and cost advantage.

The term "particulate silver" as used herein is intended to refer the discrete, particulate material generally 1–10 mm. in diameter. Preferred are silver needles which is a term applied to particulate silver obtained by isolating silver electrolytically from solution without any further reforming.

The anodes of the present invention may comprise particulate silver loose (retained by a barrier such as parchment); in a conductive or non-conductive binder or adhered to a conductive or non-conductive support. preferred supports include polyester, polymethyl methacrylate or graphite structures, such as plates. The particulate silver may be adhered by any suitable adhesive. Care should be taken, however, in the case of conductive supports, that good electrical contact be maintained between the silver needles and the support. Thus, one of the advantages of the present invention comprise the ready employment of an anode of substantially any desired shape. Any shape support can be selected and then the particulate silver adhered thereto.

The cathode employed in the present invention may comprise any material capable of generating halide ions. In a preferred embodiment the cathode disclosed and claimed in copending application Ser. No. 775,044, filed concurrently herewith, is employed.

Any suitable electrolyte which is not detrimental to the photographic process and which does not require a removal step may be employed. Electrolytes may also be selected for other utility in addition to electrical conductance. Such electrolytes may also function as pH buffers, pAg buffers, redox buffers, developing agents, Ostwald ripening agents, quaternary salts, dispersants and surfactants. Chemical and spectral sensitizing agents may also be present in the electrolyte during electrolysis to provide sensitization of the grains as they are formed.

It has also been found that a conductive polymer such as those disclosed and claimed in copending application Ser. No. 775,046; can be employed as the electrolyte, thus providing both the conductivity required and at least a portion of the binder material. A particularly useful conductive polymer comprises poly-2-acrylamido-2-methylpropane sulfonic acid.

The following non-limiting examples illustrate the novel cells of the present invention:

EXAMPLE 1

A cell was constructed composed of a flat Teflon tank assembly 6 inches × 6 inches × 1 inch; an anode comprising 300 g. of silver needles as a slurry in 100 ml. of poly-2-acrylamido-2-methylpropane sulfonic acid in water (5.5% solids) behind a cellophane dialysis sheet with a platinum wire contact; a cathode comprising 5 ml. of elemental bromine in 120 ml. of poly-2-acrylamido-2-methylpropane sulfonic acid in water (8% solids) with a platinum screen contact; and, as an electrolyte 500 ml. of poly-2-acrylamido-2-methylpropane sulfonic acid in water (5.5% solids). The cell was run for ½ hour with a current efficiency (amp/liter) of 1.3. Current efficiency, or current flow per unit volume (amps/liter), determines the time the cell must operate to reach a usefully coatable silver concentration. Turbidity increased with time indicating that grains were forming.

EXAMPLE 2

A cell was constructed as in Example 1 except that the anode comprised 100 g. of silver needles adhesively secured to a paper support with a pyroxylin based cement sold under the trade name of DUCO by E. I. duPont de Nemours & Co, Wilmington, Delaware. The cell was operated for 3 hours with a current efficiency of 2.6. Turbidity increased as grains were formed and analysis showed the emulsion to contain 2.4% silver.

EXAMPLE 3

A cell was constructed as in Example 1 except that the anode comprised 66 g. of silver needles adhesively secured to a polymethyl methacrylate support with DUCO cement. The cell was operated for 3 hours with a current efficiency of 1.3. Turbidity increased as grains were formed and analysis showed the emulsion to contain 2.0% silver.

EXAMPLE 4

A cell was constructed employing a 600 ml. beaker; an anode comprising 140 g. of silver needles secured to a polyester support with DUCO cement; a cathode comprising a sintered glass thimble retaining 30 g. of carbon black, 5 ml. of elemental bromine and 200 ml. of poly-2-acrylamido-2-methylpropane sulfonic acid in water (5.5% solids) and 200 ml. of the same polymer solution as the electrolyte. The cell was operated for 1 hour with a current efficiency of 0.8. Turbidity increased as grains were formed and analysis showed the emulsion to contain 0.72% silver.

EXAMPLE 5

A cell was constructed and operated as in Example 1 except that the distance between the electrodes was ½ inch and the temperature of the cell was raised to 60° C. The current efficiency was 4.5. Turbidity increased as grains were formed.

With regard to the use of chemical sensitizing agents suitable for employment in the present invention, mention may be made of U.S. Pat. Nos. 1,574,944; 1,623,499; 2,410,689; 2,597,856; 2,597,915; 2,487,850; 2,518,698; 2,521,926; and the like as well as Neblette, C. B., *Photography, Its Materials and Processes,* 6th Ed., 1962.

Spectral sensitization of the silver halide grains may be accomplished by contacting the grains with an effective concentration of the selected spectral sensitizing dyes dissolved in an appropriate dispersing solvent such as methanol, ethanol, acetone, water and the like; all according to the traditional procedures of the art, as described in Hamer, F. M., *The Cyanine Dyes and Related Compounds,* as well as the abovementioned disposition of the sensitizers of the electrolyte solution prior to or during grain formation.

Reduction sensitization of the grains prior to or subsequent to the addition of the binder may also be accomplished employing conventional materials known to the art, such as stannous chloride.

Sensitizers of the solid semiconductor type, such as lead oxide, may also be employed.

Additional optional additives, such as coating aids, hardeners, viscosity-increasing agents, stabilizers, preservatives, and the like, also may be incorporated in the emulsion formulation, according to the conventional procedures known in the photographic emulsion manufacturing art.

What is claimed is:

1. In a method which comprises the electrolytic generation of silver ions and halide ions employing a silver anode and a cathode which is a source of halide ions and precipitation in the electrolyte of the ion pairs remote from the electrodes to provide photosensitive silver halide grains in the substantial absence of counterions in said electrolyte;

the improvement wherein said anode comprises particulate silver.

2. The method as defined in claim 1 wherein said particulate silver comprises silver needles.

3. The method as defined in claim 2 wherein said silver needles are retained in an electrolyte permeable container.

4. The method as defined in claim 2 wherein said silver needles are disposed in a binder.

5. The method as defined in claim 4 wherein said binder is a conductive polymer.

6. The method as defined in claim 1 wherein said silver needles are adhesively secured to a support.

7. The method as defined in claim 6 wherein said support is non-conductive.

8. The cell as defined in claim 6 wherein said support is conductive.

9. The method as defined in claim 8 wherein said support is graphitic carbon.

* * * * *